US012650001B2

(12) United States Patent
Kraft et al.

(10) Patent No.: US 12,650,001 B2
(45) Date of Patent: Jun. 9, 2026

(54) FINE GRADING SYSTEM AND METHOD FOR A WORK MACHINE WITH A BOX BLADE GRADING ATTACHMENT

(71) Applicant: Deere & Company, Moline, IL (US)

(72) Inventors: Anthony K. Kraft, Epworth, IA (US); John Vikram Gundupalli, Pune (IN); John H Meinert, Farley, IA (US)

(73) Assignee: DEERE & COMPANY, Moline, IL (US)

( * ) Notice: Subject to any disclaimer, the term of this patent is extended or adjusted under 35 U.S.C. 154(b) by 418 days.

(21) Appl. No.: 18/500,217

(22) Filed: Nov. 2, 2023

(65) Prior Publication Data

US 2025/0146251 A1 May 8, 2025

(51) Int. Cl.
*E02F 3/84* (2006.01)
*E02F 3/76* (2006.01)

(52) U.S. Cl.
CPC ..... *E02F 3/844* (2013.01); *E02F 3/7618* (2013.01)

(58) Field of Classification Search
CPC ..... E02F 3/844; E02F 3/7618; E02F 3/8152; E02F 3/8155; E02F 3/7672; E02F 3/7622; E02F 3/7677; E02F 3/34; E02F 3/7663; E02F 3/7631; E02F 3/7668; E02F 3/84
See application file for complete search history.

(56) References Cited

U.S. PATENT DOCUMENTS

| | | | | |
|---|---|---|---|---|
| 4,524,532 | A | 6/1985 | Browning | |
| 8,813,864 | B2 | 8/2014 | Layton | |
| 9,017,005 | B2 | 4/2015 | Martin et al. | |
| 10,584,464 | B2 | 3/2020 | Armstrong | |
| 10,961,685 | B2 * | 3/2021 | Ono | E02F 3/7631 |
| 2013/0284466 | A1 | 10/2013 | Layton | |
| 2021/0010232 | A1 | 1/2021 | Rose | |
| 2021/0372083 | A1 | 12/2021 | Velde et al. | |
| 2022/0349148 | A1 | 11/2022 | Kumbhar et al. | |
| 2022/0381002 | A1 | 12/2022 | Nier | |
| 2024/0026636 | A1 * | 1/2024 | Sharp | E02F 3/7668 |

* cited by examiner

*Primary Examiner* — Joseph M Rocca
*Assistant Examiner* — Robert E Pezzuto

(57) ABSTRACT

A fine grading system for a work machine with a frame, a boom assembly, an attachment coupler, a grading box, and an upper attachment frame portion extending forward of the grading box with a stabilizer wheel. A controller, a positioning unit, a hydraulic circuit communicatively coupled to the controller are configured to selectively adjust at least one proportional relief valve as a function of the output signals from sensors coupled to the pitch hydraulic actuators and the boom hydraulic actuators corresponding to the grading pressure to be generated by the actuators to position the grading box with respect to the ground surface. The system and method controls at least one proportional relief valve to maintain a target pressure.

20 Claims, 6 Drawing Sheets

FINE GRADING SYSTEM AND METHOD FOR A WORK MACHINE WITH A BOX BLADE GRADING ATTACHMENT

CROSS-REFERENCE TO RELATED APPLICATIONS

N/A

TECHNICAL FIELD

The present disclosure relates generally to a system and method for a work machine with grade control.

BACKGROUND

Current box blade implements on small work machines, such as compact track loaders, are used to carry material and create a level surface. Some box blade grading attachments include wheel(s) at a forward portion of the box blade grading attachment to stabilize the attachment during final grading. However, when leveling large material piles, the wheels may be an obstruction. Furthermore, uneven terrain may pose reduced adaptation of the box blade grading attachment if the change in terrain is large. Therein lies an opportunity to improve a box blade grading attachment design.

SUMMARY

According to an aspect of the present disclosure, a fine grading system and method for a work machine is disclosed. The system comprises of a frame, a boom assembly, an attachment coupler, a grading box, an upper attachment frame portion, a ground-engaging stabilizer wheel, a positioning unit, a controller and a hydraulic circuit. The frame is supported by a plurality of ground-engaging units configured to support the frame on a surface. The boom assembly is coupled to the frame and includes a pair of boom arms pivotally coupled to the frame wherein the boom arms are movable relative to the frame by a pair boom hydraulic actuator. The attachment coupler is coupled to a distal portion of the pair of boom arms. The attachment coupler is movable relative to the frame by a pair of pitch hydraulic actuators. A grading box is coupled to the attachment coupler and extends transversely to the frame. The upper attachment frame portion has an upper attachment frame length extending forward of the grading box. The ground-engaging stabilizer wheel is coupled to a distal portion of the upper attachment frame portion. A positioning unit is configured to at least raise or lower the grading box relative to the frame via the boom hydraulic actuators and the pitch hydraulic actuators. The hydraulic circuit is coupled to a controller and includes a hydraulic pump, a first hydraulic sensor, and a second hydraulic sensor. The hydraulic pump is coupled to the boom hydraulic actuators and the pitch hydraulic actuators. The hydraulic pump delivers fluid through a plurality of flow paths. The plurality of flow paths couples the boom hydraulic actuators, the pitch hydraulic actuators, and at least one proportional relief valve. The first hydraulic sensor is coupled to the pitch hydraulic actuators and configured to generate a first output signal. The first output signal corresponds to a grading pressure of the pitch hydraulic actuators. The second hydraulic sensor is coupled to the boom hydraulic actuators and is configured to generate a second output signal corresponding to a grading pressure of the boom hydraulic actuators. The controller is functionally linked to the first sensor, the second sensor, and the positioning unit. The controller is further configured to selectively adjust the at least one proportional relief valve as a function of the first output signal, and the second output signal corresponding to the grading pressure to be generated by the pitch hydraulic actuators and the boom hydraulic actuators, respectively, to position the grading box with respect to the ground surface. The controller automatically controls the at least one proportional relief valve to maintain the target pressure.

The fine grading system further comprises of a user input interface communicatively coupled to the controller. The user input interface enables an operator to command the target grading pressure.

A stabilizer wheel is coupled to a second proportional relief valve, wherein the stabilizer wheel hydraulic actuator is coupled to and orthogonally oriented to the upper attachment frame portion. The stabilizer wheel hydraulic actuator is detachably coupled to the hydraulic circuit and the controller. The stabilizer wheel hydraulic actuator displaces the stabilizer wheel relative to the upper attachment frame portion as a function of the target grading pressure and a sensed pressure on the stabilizer wheel hydraulic actuator, the displacing controlled through the second proportional relief valve.

The controller may further selectively generate a stabilizer wheel hydraulic actuator float signal indicative of float movement of the stabilizer hydraulic actuator by calculating a pitch angle differential between the frame and the upper attachment frame portion.

The controller may further be configured to automatically enable a fine grading mode when the positioning unit lower the grading box in a defined lift range.

The controller may further selectively generate a pitch hydraulic actuator float signal indicative of float movement of the pitch hydraulic actuator by calculating a pitch angle differential between the frame and the upper attachment frame portion.

The forward portion of the upper attachment frame length comprises of a first arm extending transversely from a first side of the upper attachment frame portion, and a second arm extending transversely from a second side of the upper attachment frame portion.

The first arm and the second arm may include a series of locking pin holes configured to selectively receive a locking pin. The locking pin is selectively movable between a retracted position in which the locking pin is out of the locking pin hole, and a deployed position in which the locking pin extends into the locking pin hole and a stabilizer wheel assembly. The deployed position locks the stabilizer wheel to a position in one of the first arm and the second arm. The locking pin holes may further enable locking the stabilizer wheel assembly in a lowered position engaging the ground or an upright stowed position. The locking pin holes allow repositioning of the stabilizer wheel assembly along the length of the first arm and the second arm.

The controller may further be configured to automatically enable the fine grading mode upon activating a hard boom lock mode. The hard boom lock mode is configured to move from an unlocked position where the boom arms are moveable, to an unlocked position where the boom arms lock to the frame in the lowered position.

A method of controlling a grading box relative to a frame of the work machine to fine grade a ground surface includes the following. In a first step, the method detects via a first hydraulic sensor coupled to the pitch hydraulic actuators, a first output signal corresponding to a grading pressure of the pitch hydraulic actuators relative to the ground surface. In a next step, the method includes detecting via a second hydraulic sensor coupled to the boom hydraulic actuators, a second output signal corresponding to a grading pressure of the boom hydraulic actuators relative to the ground surface. In a next step, the method includes setting a target grading pressure, and then lowering the grading box relative to the frame within a defined lift range via the pitch hydraulic actuators and the boom hydraulic actuators to engage the ground surface.

The method then includes automatically controlling a proportional relief valve to maintain the target pressure as a function of the first output signal and the second output signal to maintain the target pressure. The target grading pressure may be received from one of a remote user input interface or a local user input interface wherein the user input interface enables an operator to command the target grading pressure. The method then includes detecting a third output signal via a third hydraulic sensor coupled to a stabilizer wheel hydraulic actuator, wherein the stabilizer wheel hydraulic actuator is coupled to and orthogonally oriented to an upper attachment frame portion extending forward of the work machine. The method then includes displacing the stabilizer wheel relative to the upper attachment frame portion as a function of the target grading pressure and a sensed pressure from the third output signal. Displacement of the stabilizer wheel occurs through a second proportional relief valve coupled to the stabilizer wheel actuator. The method may then include generating a stabilizer wheel hydraulic actuator float signal indicative of float movement of the stabilizer hydraulic actuator by calculating a pitch angle differential between the frame and the upper attachment frame portion wherein the pitch angle differential meets a defined threshold. The method may further comprise generating a pitch hydraulic actuator float signal indicative of float movement of the pitch hydraulic actuator by calculating a pitch angle differential between the frame and the upper attachment frame portion wherein the pitch angle differential meets a defined threshold. The method may further comprise of adjusting a stabilizer wheel assembly position along a length of the first arm or the second arm and deploying a locking pin into the locking pin hole to secure the stabilizer wheel assembly. The locking pin holes may further enable locking the stabilizer wheel assembly in a lowered position engaging the ground surface and an upright stowed position.

Other features and aspects will become apparent by consideration of the detailed description, claims, and accompanying drawings.

BRIEF DESCRIPTION OF THE DRAWINGS

The detailed description of the drawings refers to the accompanying figures.

Like reference numerals are used to indicate like elements throughout the several figures.

DETAILED DESCRIPTION

Figure 1:
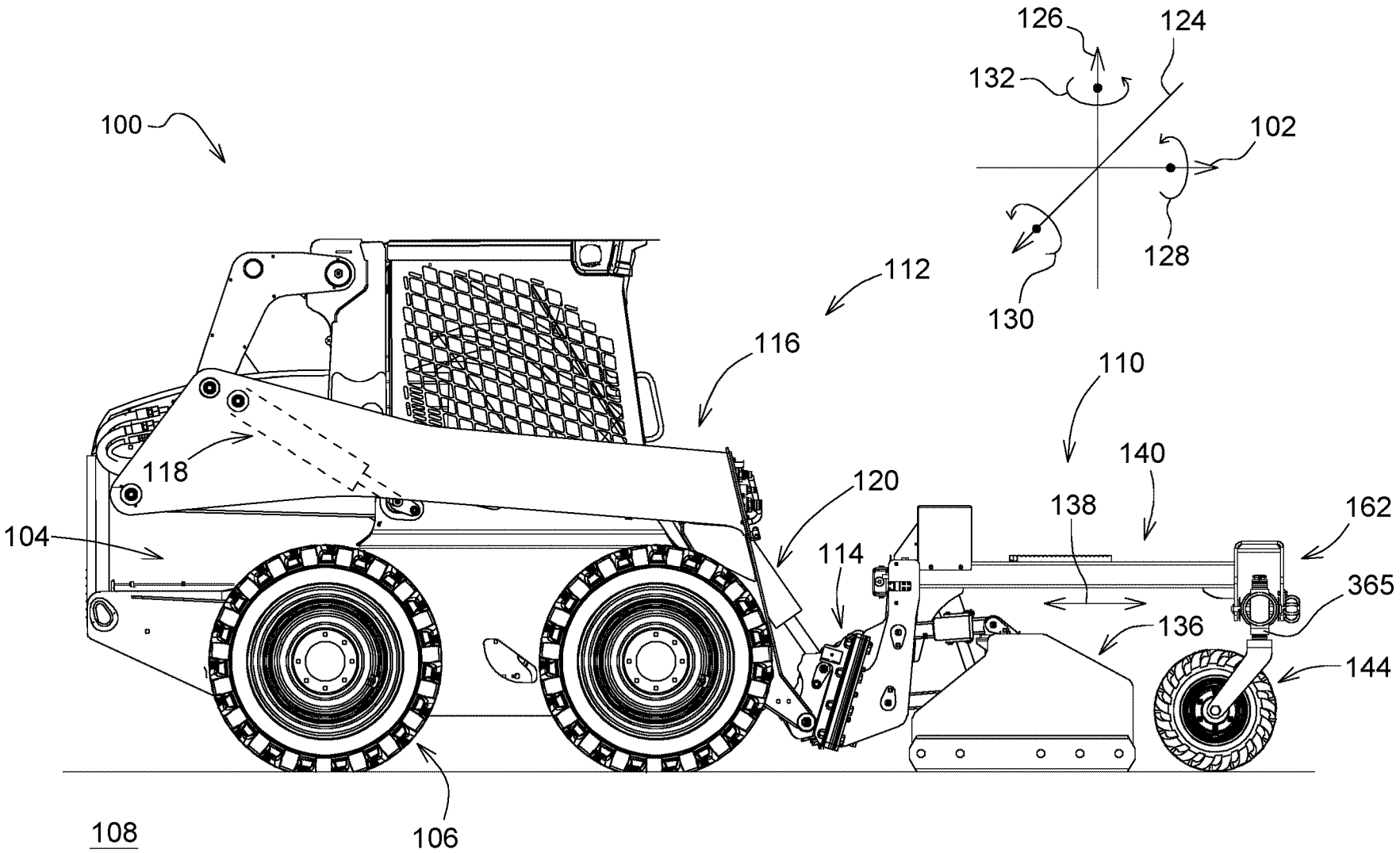
FIG. 1 is a side view of a work machine, shown as a compact track loader, with a grading box.

As used herein, "e.g." is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Terms of degree, such as "generally", "substantially" or "approximately" are understood by those of ordinary skill to refer to reasonable ranges outside of a given value or orientation, for example, general tolerances or positional relationships associated with manufacturing, assembly, and use of the described embodiments.

As used herein, "controller" is intended to be used consistent with how the term is used by a person of skill in the art, and refers to a computing component with processing, memory, and communication capabilities, which is utilized to execute instructions (i.e., stored on the memory or received via the communication capabilities) to control or communicate with one or more other components. In certain embodiments, the controller may be configured to receive input signals in various formats (e.g., hydraulic signals, voltage signals, current signals, CAN messages, optical signals, radio signals), and to output command or communication signals in various formats (e.g., hydraulic signals, voltage signals, current signals, CAN messages, optical signals, radio signals).

The controller may be in communication with other components on the work machine, such as hydraulic components, electrical components, and operator inputs within an operator station of an associated work machine. The controller may be electrically connected to these other components by a wiring harness such that messages, commands, and electrical power may be transmitted between the controller and the other components. Although the controller is referenced in the singular, in alternative embodiments the configuration and functionality described herein can be split across multiple devices using techniques known to a person of ordinary skill in the art. The controller 84 includes the tangible, non-transitory memory 85 on which are recorded computer-executable instructions, including a predictive maintenance for a track chain undercarriage algorithm. The processor of the controller is configured for executing the predictive maintenance algorithm.

The controller may be embodied as one or multiple digital computers or host machines each having one or more processors, read only memory (ROM), random access memory (RAM), electrically-programmable read only memory (EPROM), optical drives, magnetic drives, etc., a high-speed clock, analog-to-digital (A/D) circuitry, digital-to-analog (D/A) circuitry, and any required input/output (I/O) circuitry, I/O devices, and communication interfaces, as well as signal conditioning and buffer electronics.

Figure 2:
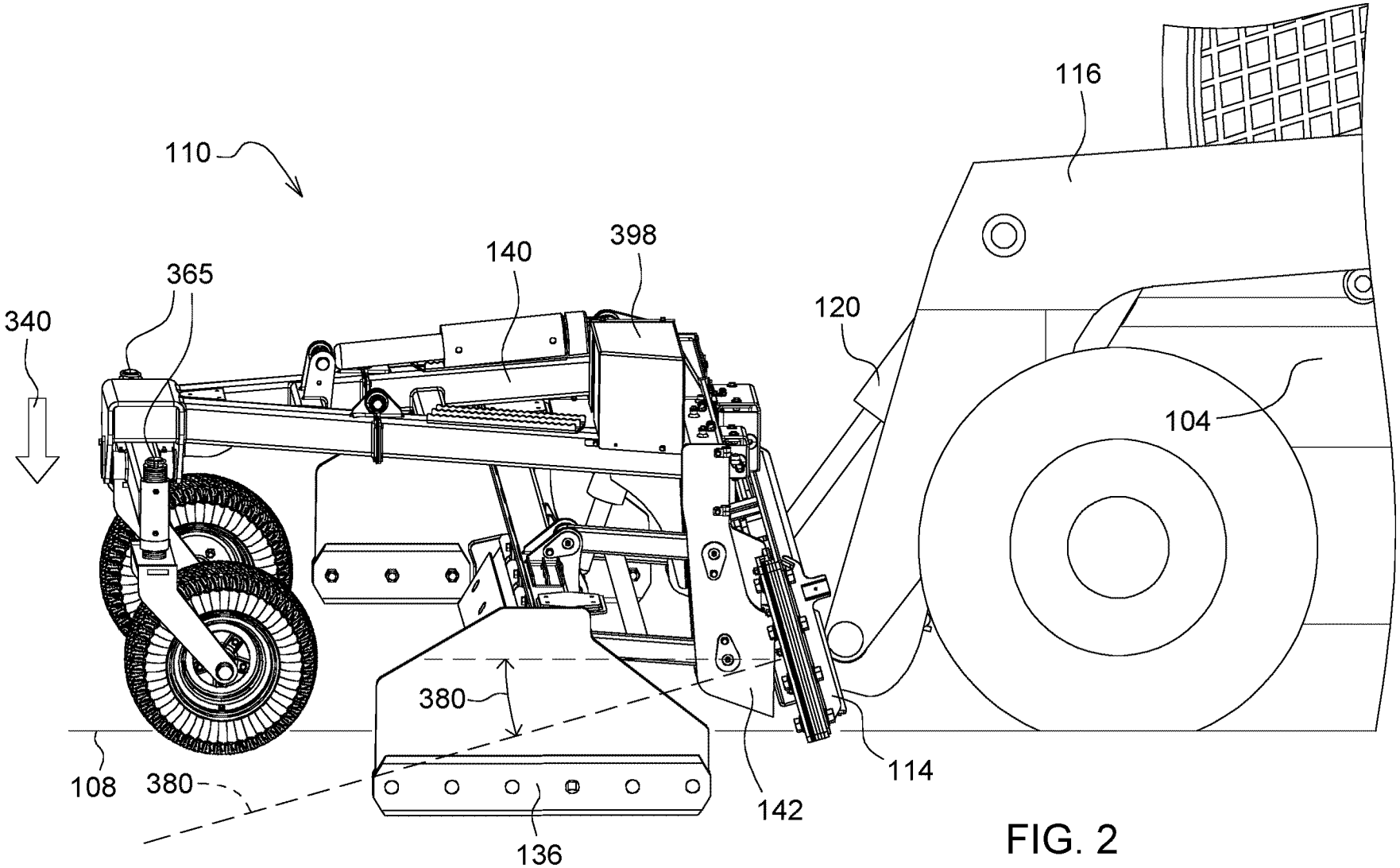
FIG. 2 is an opposing side view of the attachment and the forward portion of the work machine shown in FIG. 1.

FIGS. 1 and 2 illustrate a work machine 100, depicted as a compact track loader with an attachment operatively coupled to a fore portion of the work machine. It should be understood, however, that the work machine 100 could be one of many work machines, including, and without limitation, a skid steer, a front loader, and other construction work machines. The work machines shown here, has a frame 104 with ground-engaging units 106 configured to support the frame 104 on a ground surface 108. The illustrated ground-engaging units 106 comprises of tracks, but other embodiments can include wheels that engage the surface. Work machines include an attachment to allow an operator to engage the surface and cut and move material achieve simple or complex features on the surface. As used herein, directions with regard to the work machine may be referred to from the perspective of facing towards the attachment 110 from the frame 104 of the work machine.

The work machine 100 comprises of a boom assembly 112 pivotally coupled to the frame 104. An attachment 110, or more specifically, a box blade grading attachment 110 is pivotally coupled at a forward portion of the boom assembly 112. The box blade grading attachment 110 is coupled to the boom assembly 112 through an attachment coupler 114, such as Deere and Company's Quik-Tach, which is an industry standard coupler configuration universally applicable to many Deere attachments and several after-market attachments.

The boom assembly 112 comprises of a pair of boom arms 116 pivotally coupled to the frame 104 and moveable relative to the frame 104 by a pair of boom hydraulic actuators 118, wherein the boom hydraulic actuators 118 may also herein be referred to throughout as lift actuators. The attachment coupler 114 is coupled to a distal portion of the boom arms 116 and is moveable relative to the frame 104 by a pair of pitch hydraulic actuators 120. For this embodiment, each of the pair of boom hydraulic actuators 118 and pitch hydraulic actuators 120 are double acting hydraulic cylinders. As such, each may exert a force in the extending or retracting direction, directing pressurized hydraulic fluid into a head chamber of the cylinder to exert a force in the extending direction. Whereas, directing pressurized hydraulic fluid into a rod chamber of the hydraulic cylinder will tend to exert a force in the retracting directions. The head chamber and the rod chamber may both be located within a barrel of the hydraulic cylinder and may both be part of a larger cavity which is separated by a moveable piston connected to a rod of the hydraulic cylinder.

The box blade grading attachment 110 may be operable to engage the ground and grade, cut, and/or move material to achieve simple or complex features on the ground. When attached to and operating with a work machine 100, the box blade grading attachment 110 may experience movement in three directions and rotation in three directions. A direction of the box blade grading attachment 110 may also be referred to with regard to a longitudinal direction 102, a latitudinal or lateral direction 124, and a vertical direction 126. Rotation for box blade grading attachment 110 may be referred to as roll 128 or the roll direction, pitch 130 or the pitch direction, and yaw 132 or the yaw direction or heading. The box blade grading attachment 110 may be hydraulically actuated to move vertically up and down ("lift"), roll left or right ("tilt"), and yaw left and right ("angle").

The terms "distal" and "proximal" may be used herein to describe certain features of the box blade grading attachment. The terms "distal" and "proximal" are used in relation to the point of view of an operator located on or within the work machine 10. Thus, a proximal end of the box blade grading attachment 110 may be the end closest to the operator and the work machine. A distal end of the box blade grading attachment 110 may be the end furthest from the operator and the work machine.

Figure 5A:
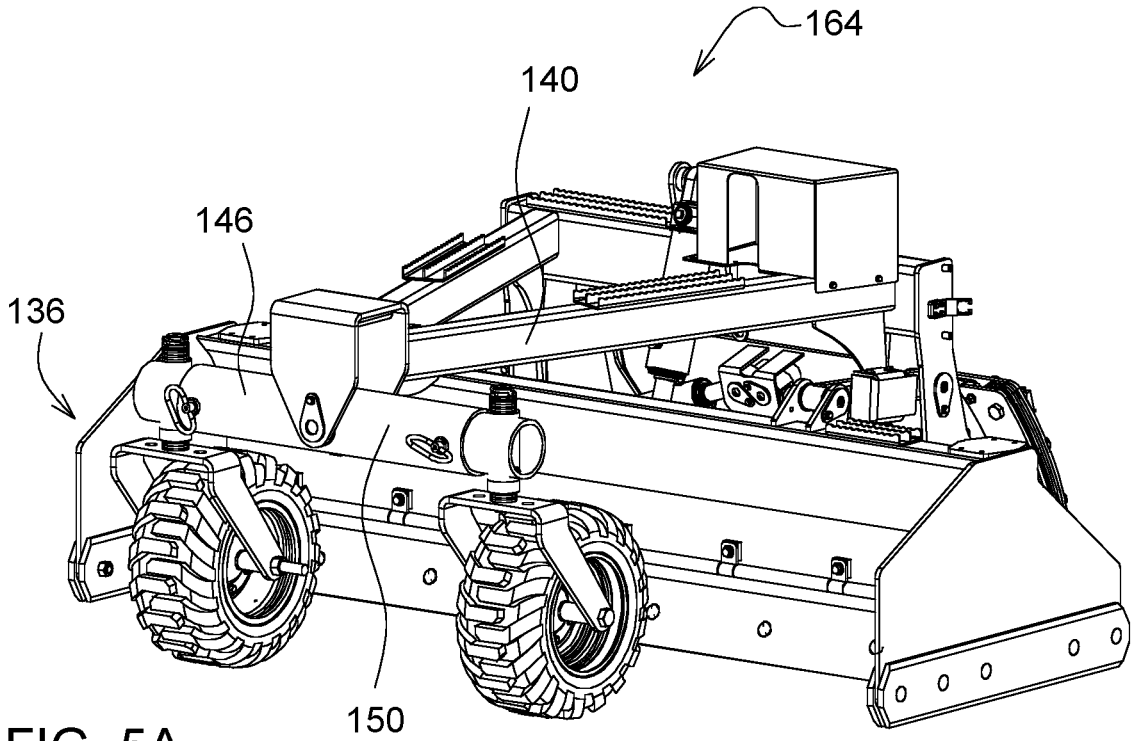
FIG. 5A is an isometric front view of the box blade grading attachment with the stabilizer wheels in a lowered position and engaging the ground surface.
Figure 5B:
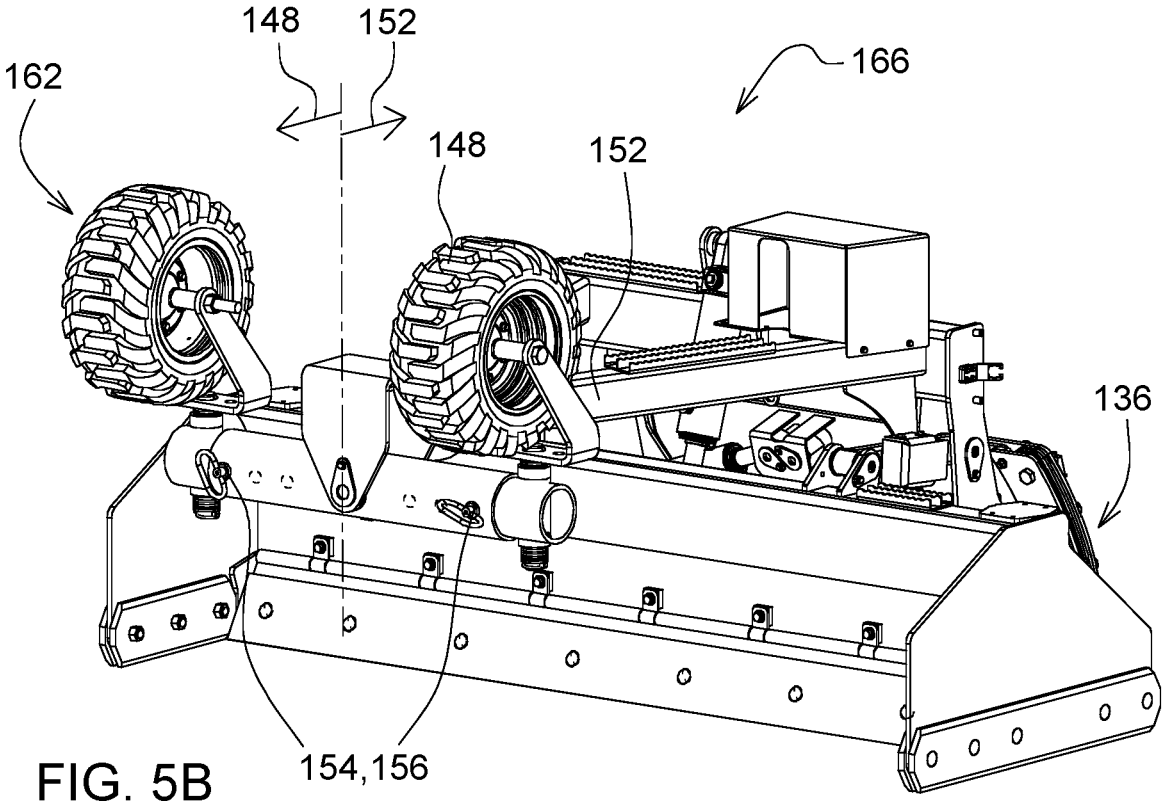
FIG. 5B is an isometric front view of the box blade grading attachment with the stabilizer wheels in an upright stowed position.

The box blade grading attachment 110 comprises of a grading box 136 extending transversely to the frame 104. The box blade grading attachment 110 includes an upper attachment frame portion 140 and a rear attachment frame portion 142. The upper attachment frame portion 140 has an upper attachment frame length 138 extending forward from the rear attachment frame portion 142. A ground-engaging stabilizer wheel 144 is coupled to a forward portion of the upper attachment frame portion 140. As shown in FIGS. 5A and 5B, a forward portion of the upper attachment frame length 138 further comprises of a first arm 146 extending transversely from a first side 148 of the upper attachment frame portion 140 and a second arm 150 extending transversely from a second side 152 of the upper attachment frame portion 140. The first arm 146 and the second arm 150 include a series of locking pin holes 154 configured to selectively receive a locking pin 156, wherein the locking pin 156 is selectively movable between a retracted position in which the locking pin 156 is out of the locking pin hole 154, and a deployed position in which the locking pin 156 extends into both the locking pin hole 154 and a portion of the stabilizer wheel assembly 162 in position on either the first arm 146 or the second arm 150. The locking pin holes 154 may enable locking the stabilizer wheel assembly 162 in a lowered position 164 (shown in FIG. 5A) engaging the ground surface 108 or alternatively, an upright stowed position 166 (shown in FIG. 5B). The locking pin holes 154 may enable repositioning of the stabilizer wheel assembly 162 along the length of the first arm 146 and the second arm 150. The technical effect of the reconfiguration mechanism is to allow the operator to pivot the wheels into a stowed position and further allow for width adjustment.

The box blade grading attachment 110 includes a coupler bracket attached to the rear attachment frame portion 142. The coupler bracket may include an attachment interface for coupling the box blade grading attachment 110 to the work machine 100. Specifically, the attachment interface may be operable to be engaged by the attachment coupler 114 of the work machine 100. The coupler bracket may include a tilt plate extending transversely to the upper attachment frame length 138 and positioned adjacent to the attachment interface.

Figure 3:
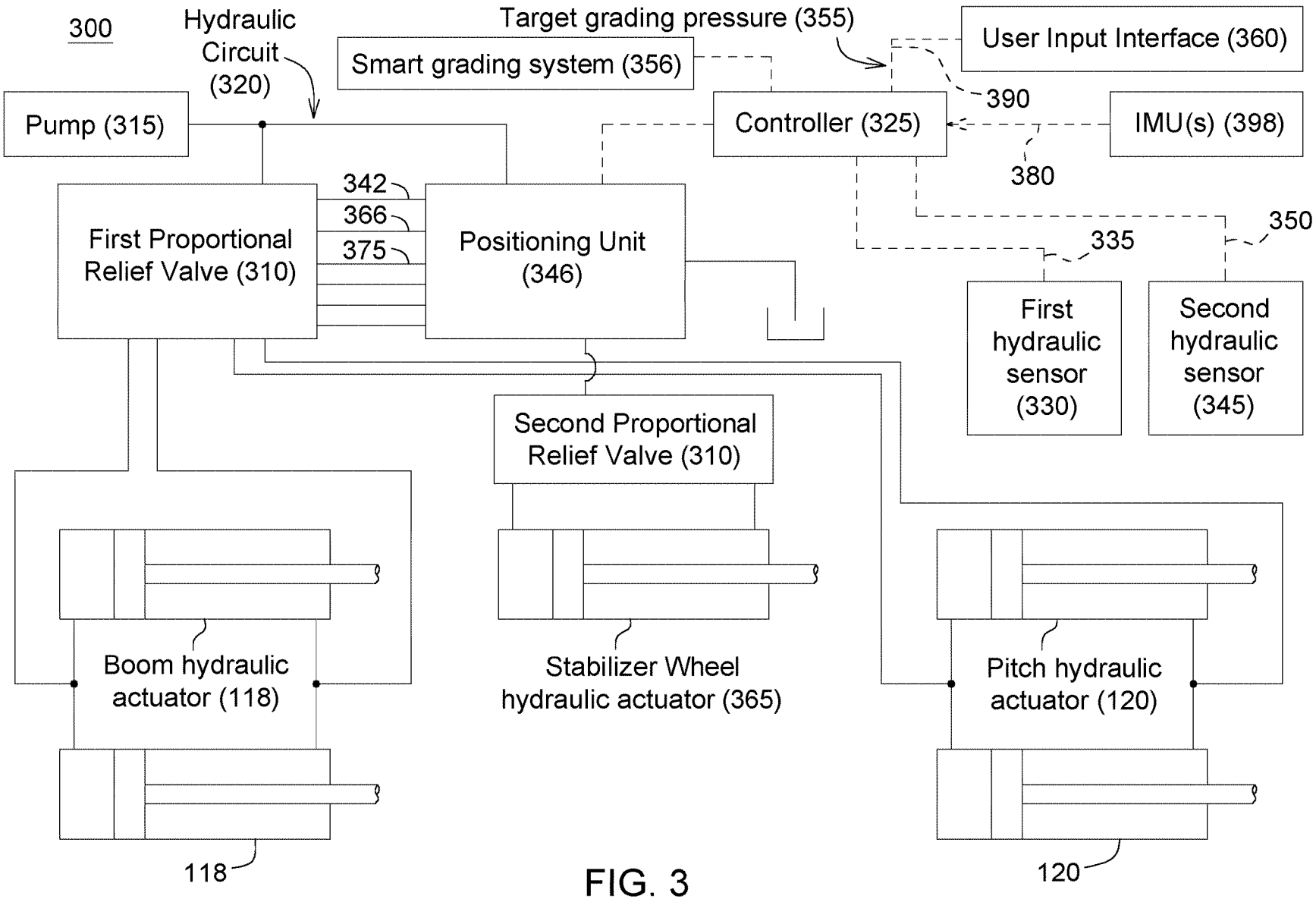
FIG. 3 is a schematic of the fine grading mode system.

FIG. 3 is an illustrative schematic of the fine grading mode system 300, including the hydraulic and electrical components for controlling a position of the box blade grading attachment 110. Each of the lift actuators 118 and pitch actuators 120 is hydraulically connected to one or more proportional relief valve(s) 310. The proportional relief valve 310 receives pressurized fluid from a hydraulic pump 315 and directs such fluid to the lift actuators 118 and the pitch actuators 120, and other circuits or functions of the work machine 100. The proportional relief valve 310 may meter such fluid out or control the flow rate of hydraulic fluid to each hydraulic circuit 320 to which it is connected. A proportional relief valve 310 is designed to maintain a consistent pressure by releasing excess fluid when pressure in the system exceeds a certain level. A proportional relief valve 310 may respond to changes in pressure in a linear, non-linear, or proportional manner wherein as the pressure in the system 300 increases, the proportional relief valve 310 will gradually open to release more fluid, and as the pressure decreases, the proportional relief valve 310 will gradually close to limit fluid flow, thereby advantageously improving precision. The hydraulic actuators such as the lift actuators 118 and the pitch actuators 120 are coupled to the outlet of the proportional relief valve 310. It regulates fluid flow to control the speed and force of the actuator. The flow rate and thereby pressure is determined by the size of the valve opening. The inclusion of the proportional relief valve 310 advantageously helps keep the system 300 stable and minimizes pressure fluctuations during sudden changes in the ground surface 108 and terrain and maintains a controlled performance of the hydraulic actuators.

The fine grading mode system 300 also includes a hydraulic circuit 320 that is communicatively coupled to a controller 325. The hydraulic circuit 320 includes a first hydraulic sensor 330 coupled to the pitch hydraulic actuators 120 and configured to generate a first output signal 335 wherein the first output signal 335 corresponds to a grading pressure 340 of the pitch hydraulic actuators 120. The system 300 may further include a second hydraulic sensor 345 coupled to the boom hydraulic actuators 118 and configured to generate a second output signal 350 corresponding to a target grading pressure 355 of the boom hydraulic actuators 118. Grading pressure refers to the downward force or weight applied by the box blade grading attachment 140 onto the ground during grading operations. Grading pressure is an important factor in achieving proper compaction and leveling of the ground surface 108. The sensors (330, 345) may sense pressure using a gauge or pressure via the hydraulic circuit 320 coupled to each respective hydraulic actuator. The sensors (330, 345) may be located near an actuator's control valve to measure the pressure of the hydraulic fluid as it enters or exits the actuator.

The hydraulic pump 315 delivers fluid through a plurality of flow paths, wherein the plurality of flow paths fluidly coupled to the boom hydraulic actuators 118, the pitch hydraulic actuators 120, and at least one proportional relief valve 310. The controller 325 is functionally linked to the first hydraulic sensor 330, the second hydraulic sensor 345, and a positioning unit 346. Define positioning unit. The box blade grading attachment 140 is movable coupled to the frame 104 of the work machine through linkage which supports and actuates the attachment 140 relative to the frame 104. The linkage may include multiple structural members to carry forces between attachment 104 and the rest of the work machine 100 and may provide attachment points for hydraulic cylinders which may actuate the attachment in the lift, tilt, and angle directions. A "positioning unit" 346 as referred to herein, and including the particulars described below with respect to FIG. 3, may for examples, comprise the linkage and or structures associated with actuation of the attachment 104 in the lift, tilt, and angle directions.

The controller 325 is further configured to selectively adjust at least one proportional relief valve 310 as a function of the first output signal 335, the second output signal 350, and a target grading pressure 355 to be generated by the pitch hydraulic actuators 120 and/or the boom hydraulic actuators 118 to position the grading box 136 with respect to the ground surface 108, and automatically controlling at least one proportional relief valve 310 in response.

The fine grading mode system 300 may further comprise of a user input interface 360 communicatively coupled to the controller 325 wherein the user input interface 360 enables an operator to set the target grading pressure 355.

The work machine 100 may further comprise of a stabilizer wheel hydraulic actuator 365 coupled to the hydraulic circuit 320 and includes a second proportional relief valve 370 for displacing the stabilizer wheel 144 relative to the upper attachment frame portion 140. The stabilizer wheel hydraulic actuator 365 may be coupled to and orthogonally oriented to the upper attachment frame portion 140. The controller 325 is communicatively coupled to the stabilizer wheel hydraulic actuator 365 and may also displace the stabilizer wheel 144 as a function of the target grading pressure 355 and a sensed pressure on the stabilizer wheel hydraulic actuator 365, wherein the displacing is induced through the second proportional relief valve 370. The second proportional relief valve 370 may be detachably coupled to the hydraulic circuit 320 of the work machine because the stabilizer wheel hydraulic actuator 365 is a component of the box blade grading attachment 110.

Now referring to FIGS. 1 through 3, the work machine may further comprise of a stabilizer wheel hydraulic actuator with a second proportional relief valve. The stabilizer wheel hydraulic actuator is coupled to and orthogonally oriented to the upper attachment frame portion 140. The stabilizer wheel hydraulic actuator is detachably coupled to the hydraulic circuit 320 and the controller 325.

Figure 4A:
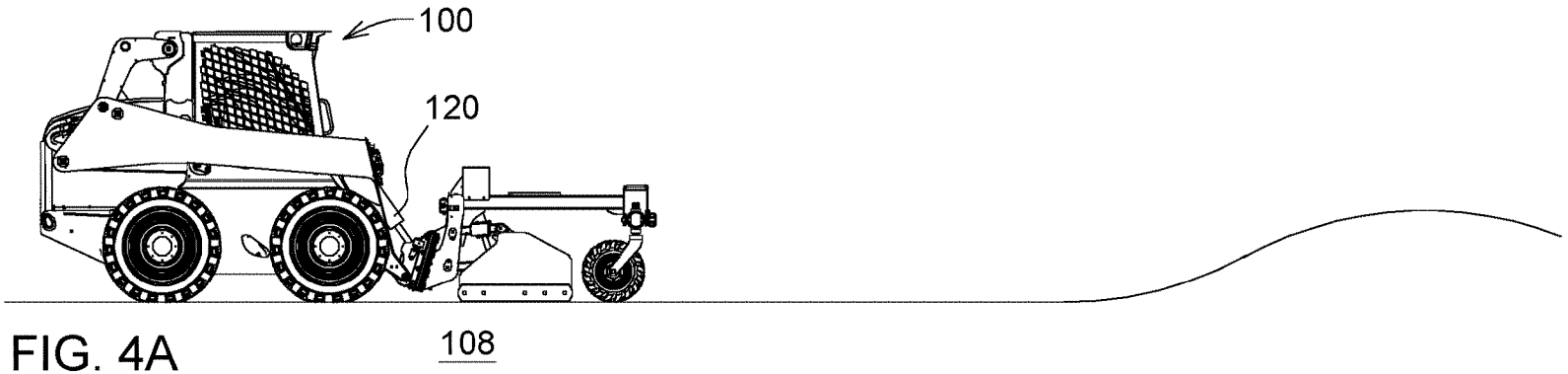
FIG. 4A (PRIOR ART)
FIG. 4A is a schematic of a work machine in the fine grading mode as it traverses across a flat ground surface.
Figure 4B:
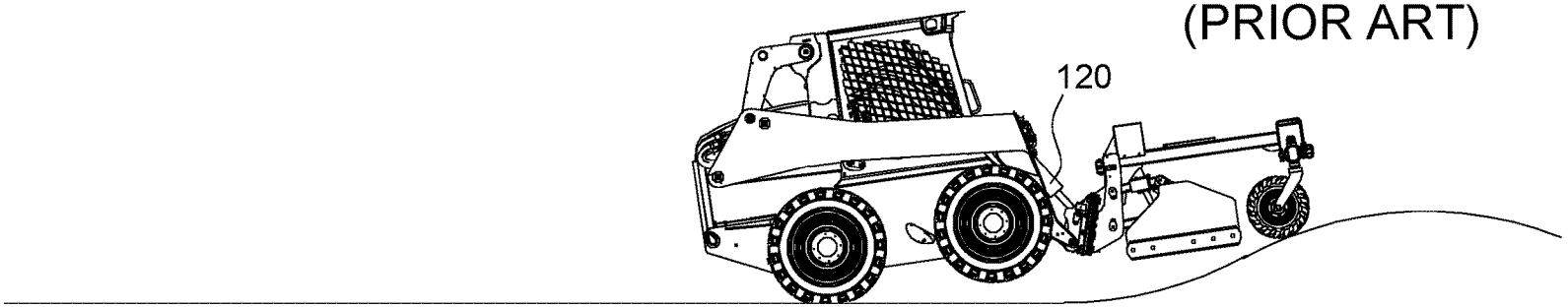
FIG. 4B is the prior art and a schematic of a work machine as it traverses across a ground surface with a sudden steep incline, without the fine grading mode system and method.
Figure 4C:
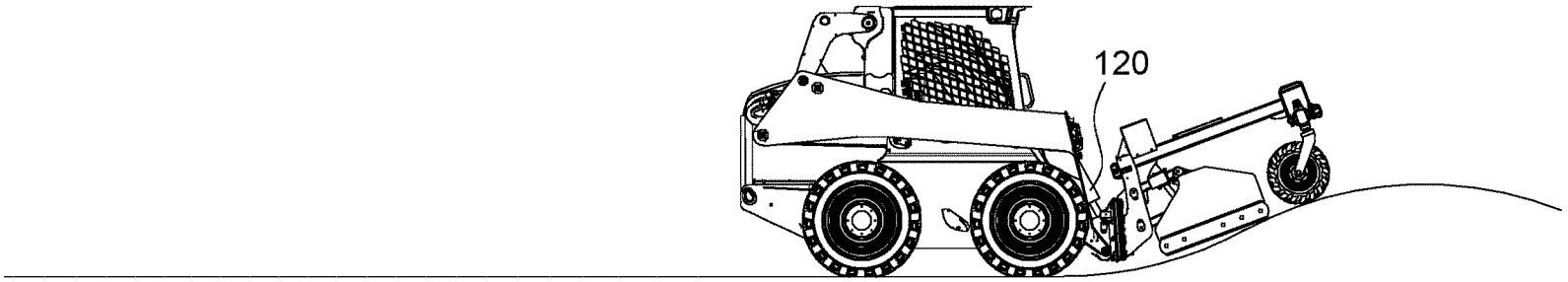
FIG. 4C is a schematic of a work machine as it traverses across a ground surface with a sudden steep incline, with the fine grading mode system and method active.

The controller 325 may further selectively generate a stabilizer wheel hydraulic actuator float signal 375 indicative of float movement of the stabilizer wheel hydraulic actuator 365 by calculating a pitch angle differential 380 between the frame and the upper attachment frame portion 140. The pitch angle differential 380 may be derived from a sudden spike in sensed pressure by one or more of the hydraulic sensors associated with the stabilizer wheel hydraulic actuator 365. In another embodiment, the pitch angle differential 380 may also be derived from IMUs 398 coupled to the frame 104 and the upper attachment frame portion 140, respectively. To achieve a float, in one embodiment for example, the stabilizer wheel hydraulic actuator may further couple with a built-in accumulator. The accumulator advantageously provides a cushioning effect from vibrations by holding an incompressible hydraulic fluid under pressure when an external source is applied, such as the vibrations or a sudden gradient change in the terrain (such as that shown in FIG. 4B).

Similarly, the controller 325 may selectively generate a pitch hydraulic actuator float signal 366 indicative of float movement of the pitch hydraulic actuator 120 by calculating a pitch angle differential 380 between the frame 104 and the upper attachment frame portion 140. or more particularly the hydraulic sensors coupled to the pitch hydraulic actuators 120. It is conceivable that the adjustment of the stabilizer wheel hydraulic actuator 365 is better suited for small grading pressure changes, and adjustments in the pitch hydraulic actuators 120 are better suited for large grading pressure changes.

The controller 325 may further be configured to automatically enable the fine grading mode 300 when the positioning unit 346 lowers the grading box 136 to a defined lift range 395.

Smart grading systems 356 control the elevation of the attachment 110 according to the grade command or grade set by the operator. With smart grading systems 356, the work machine 100 generally obtains positional information using an inertial measurement unit (IMU) 398 mounted to the frame 104 and boom assembly 112, respectively. The IMU 398 is an electronic device that measures and reports a body-specific force, angular rate, and sometimes orientation using a combination of accelerometers, gyroscopes, and occasionally magnetometers. In order to obtain positional information, the accelerometer or gyroscopic output of IMU is integrated over time. While this approach is quite effective for virtually all operational modes of a work machine, such as a compact track loader, it has limitations when the signal of the accelerometer and/or gyroscope is relatively small such as during slow or low acceleration movements. Therein, the fine grading mode system 300 advantageously supplements the smart grading system by including pressure feedback with the intend to maintain within a range of the target grading pressure 355.

The fine grading mode system 300 used as a subsequent step at a worksite or in conjunction with a smart grading system 356 advantageously allow for a work machine, such as the compact track loader, to traverse an irregular or hilly surface for grading with ease. Use of the box blade grading attachment 110 on a compact track loader further allows for use of the fine grading mode system 300, furthering easing operator control of the work machine 100. The user input interface 360 may enable the operator to activate the fine grading mode based on coupling of the box blade grading attachment 110 to the boom assembly 112. In one exemplary embodiment, the controller 325 may suggest use of the fine grading mode system 300 when the box blade grading attachment 110 is coupled to the work machine 100. The box blade grading attachment 110 is generally used for fine grade grading wherein the volume of the "box" is known thereby allowing the grading box 136 to deposit ground material at a known volume. Using the fine grading mode 300 in conjunction with the grading box 136 optimizes fine grading applications, particularly in grading boxes or grading blades with a stabilizer wheel 144.

In another embodiment, the fine grading mode 300 may initiate upon receipt of soft boom lock signal 342 described below. The transmission of the soft boom lock signal 342 (not shown) to inactivate the portion of the hydraulic circuit 320 related to the pair of boom hydraulic actuators 118 associated with movement of the pair of boom arms 116 in one or more of the lifting and the lowering of the boom arms 116 and the pair of pitch hydraulic actuators 120 related to pitching the attachment upwards and downward. In the present embodiment, for example, flow to or from the flow path of the pair of boom hydraulic actuators 118 may be inactivated wherein the pair of boom hydraulic actuators 118 are neither extended nor retracted, such that the boom assembly 112 may rests on the mounting pads (although the pads are not required) in a lowered position for fine grading. The pair of boom arms 116, in other words, would be hydraulically locked. Similarly, the pair of pitch hydraulic actuators 120 would remain stationary where the hydraulic fluid related to the portions of actuating the aforementioned hydraulic actuators (118, 120) are neither pressurized nor de-pressurized. Implementing the proposed hydraulic relief control would allow for the attachment to follow ground contour while maintaining grading pressure.

Figure 6:
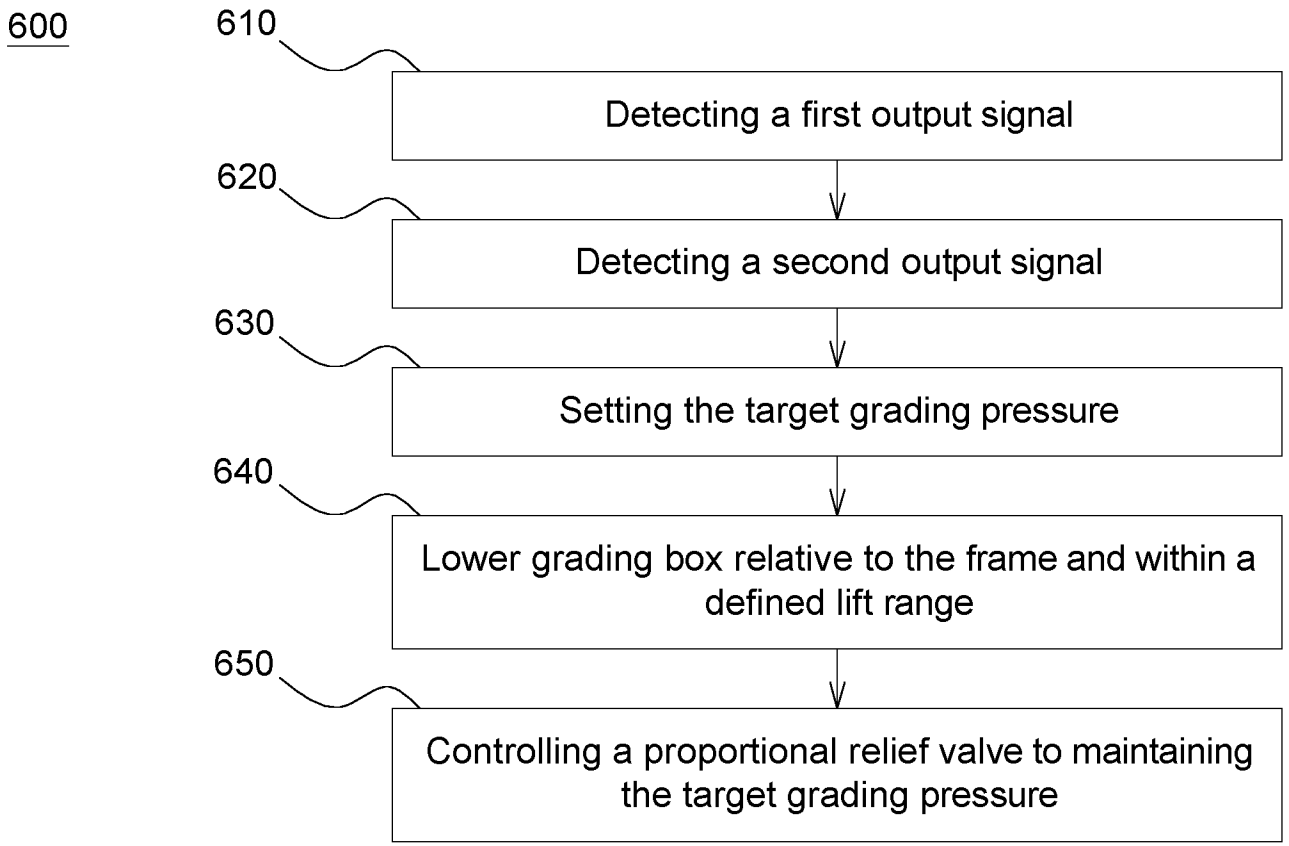
FIG. 6 is a decision tree for the system and method of fine grading a ground surface.

Now referring to FIGS. 6, a method 600 of controlling a grading box 136 relative to a frame of a work machine to fine grade a ground surface is disclosed. The method 600 comprises in step 610, detecting by the controller, via a first hydraulic sensor coupled to the pitch hydraulic actuators a first output signal. The first output signal corresponds to a grading pressure of the pitch hydraulic actuators relative to the ground surface.

In a next step 620, the method includes detecting by the controller, via second hydraulic sensor coupled to the boom hydraulic actuators, a second output signal. The second output signal corresponds to a grading pressure of the boom hydraulic actuators relative to the ground surface.

In step 630, the method includes setting the target grading pressure.

In step 640, the method includes lowering the grading box 136 relative to the frame within a defined lift range via the pitch hydraulic actuators and the boom hydraulic actuators to engage the ground surface.

The method, in step 650, includes automatically controlling a proportional relief valve to maintain the target grading 12 pressure as a function of the first output signal and the second output signal to maintain the target pressure.

Without in any way limiting the scope, interpretation, or application of the claims appearing below, a technical effect of one or more of the example embodiments disclosed herein is positioning the linkage to achieve the appropriate grading pressure irrespective of unforeseen objects, change in soil moisture content, and changes in ground surfaces. Another technical effect is maintaining an optimal grading pressure to ensure efficient and effective grading operations while minimizing potential damage to the equipment by the ground surface, and thereby potentially improving the lift use of the attachment.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A fine grading system for a work machine, the system comprising:

a frame supported by a plurality of ground-engaging units, the ground-engaging units configured to support the frame on a surface;

a boom assembly coupled to the frame, the boom assembly having a pair of boom arms pivotally coupled to the frame and movable relative to the frame by a pair of boom hydraulic actuators;

an attachment coupler coupled to a distal portion of the pair of boom arms, the attachment coupler movable relative to the frame by a pair of pitch hydraulic actuators;

a grading box coupled to the attachment coupler, the grading box extending transversely to the frame;

an upper attachment frame portion having an upper attachment frame length extending forward of the grading box;

a ground-engaging stabilizer wheel coupled to a distal portion of the upper attachment frame portion;

a controller;

a positioning unit configured to at least raise or lower the grading box relative to the frame via the boom hydraulic actuators and the pitch hydraulic actuators, a hydraulic circuit communicatively coupled to the controller, the hydraulic circuit including a hydraulic pump coupled to the boom hydraulic actuators and the pitch hydraulic actuators, the hydraulic pump delivering fluid through a plurality of flow paths, the plurality of flow paths coupled the boom hydraulic actuators, the pitch hydraulic actuators, and at least one proportional relief valve;

a first hydraulic sensor coupled to the pitch hydraulic actuators and configured to generate a first output signal, the first output signal corresponding to a grading pressure of the pitch hydraulic actuators;

a second hydraulic sensor coupled to the boom hydraulic actuators and configured to generate a second output signal corresponding to a grading pressure of the boom hydraulic actuators; and wherein the controller is functionally linked to the first sensor, the second sensor, and the positioning unit, and configured to selectively adjust the at least one proportional relief valve as a function of the first output signal and the second output signal corresponding to the grading pressure to be generated by the pitch hydraulic actuators and the boom hydraulic actuators, respectively, to position the grading box with respect to the ground surface; the controller automatically controlling the at least one proportional relief valve to maintain a target pressure.

2. The fine grading system of claim 1, further comprising a user input interface communicatively coupled to the controller, the user input interface enabling an operator to command the target grading pressure.

3. The fine grading system of claim 1, further comprising:

a stabilizer wheel hydraulic actuator coupled to a second proportional relief valve, wherein the stabilizer wheel hydraulic actuator is coupled to and orthogonally oriented to the upper attachment frame portion, the stabilizer wheel hydraulic actuator detachably coupled to the hydraulic circuit and the controller, the stabilizer wheel hydraulic actuator displacing the stabilizer wheel relative to the upper attachment frame portion as a function of the target grading pressure and a sensed pressure on the stabilizer wheel hydraulic actuator, the displacing controlled through the second proportional relief valve.

4. The fine grading system of claim 3, wherein the controller selectively generates a stabilizer wheel hydraulic actuator float signal indicative of float movement of the stabilizer hydraulic actuator by calculating a pitch angle differential between the frame and the upper attachment frame portion.

5. The fine grading system of claim 1, wherein the controller is configured to automatically enable the fine grading mode when the positioning unit lowers the grading box in a defined lift range.

6. The fine grading system of claim 1, wherein the controller selectively generates a pitch hydraulic actuator float signal indicative of float movement of the pitch hydraulic actuator by calculating a pitch angle differential between the frame and the upper attachment frame portion.

7. The fine grading system of claim 1, wherein a forward portion of an upper attachment frame length comprises:

a first arm extending transversely from a first side of the upper attachment frame, and a second arm extending transversely from a second side of the upper attachment frame, wherein the first arm and the second arm include a series of locking pin holes configured to selectively receive a locking pin, wherein the locking pin is selectively movable between a retracted position in which the locking pin is out of the locking pin hole, and a deployed position in which the locking pin extends into the locking pin hole and a stabilizer wheel assembly, locking the stabilizer wheel to a position in one of the first arm and the second arm.

8. The fine grading system of claim 7, wherein the locking pin holes further enable locking the stabilizer wheel assembly in a lowered position engaging the ground and an upright stowed position.

9. The fine grading system of claim 7, wherein the locking pin holes enable repositioning the stabilizer wheel assembly along the length of the first arm and the second arm.

10. The fine grading system of claim 1, wherein the controller is configured to:

automatically enable the fine grading mode upon activating a hard boom lock mode, the hard boom lock mode is configured to move from an unlocked position where the boom arms are moveable, to an unlocked position where the boom arms lock to the frame in the lowered position.

11. A method of controlling a grading box relative to a frame of a work machine to fine grade a ground surface, the method comprising:

detecting, via a first hydraulic sensor coupled to a pair of pitch hydraulic actuators, a first output signal corresponding to a grading pressure of the pitch hydraulic actuators relative to the ground surface;

detecting, via a second hydraulic sensor coupled to a pair of boom hydraulic actuators, a second output signal corresponding to a grading pressure of the boom hydraulic actuators relative to the ground surface;

setting a target grading pressure;

lowering the grading box relative to the frame within a defined lift range via the pitch hydraulic actuators and the boom hydraulic actuators to engage the ground surface;

automatically controlling a proportional relief valve to maintain the target pressure as a function of the first output signal and the second output signal to maintain the target pressure.

12. The method of claim 11, wherein setting the target grading pressure is received from one of a remote user input interface or a local user input interface, the user input interface enabling an operator to command the target grading pressure.

13. The method of claim 11, further comprising:

detecting a third output signal via a third hydraulic sensor coupled to a stabilizer wheel hydraulic actuator, the stabilizer wheel hydraulic actuator coupled to and orthogonally oriented to an upper attachment frame portion extending forward of the work machine, and displacing the stabilizer wheel relative to the upper attachment frame portion as a function of the target grading pressure and a sensed pressure from the third output signal.

14. The method of claim 13, wherein displacing the stabilizer wheel occurs through a second proportional relief valve coupled to the stabilizer wheel hydraulic actuator.

15. The method of claim 14 further comprising:

generating a stabilizer wheel hydraulic actuator float signal indicative of float movement the stabilizer hydraulic actuator by calculating a pitch angle differential between the frame and the upper attachment frame portion, the pitch angle differential meeting a defined threshold.

16. The method of claim 11, further comprising:

generating a pitch hydraulic actuator float signal indicative of float movement of the pitch hydraulic actuator by calculating a pitch angle differential between the frame and the upper attachment frame portion, the pitch angle differential meeting a defined threshold.

17. The method of claim 13, wherein a forward portion of an upper attachment frame length comprises of:

a first arm extending transversely from a first side of the upper attachment frame, and a second arm extending transversely from a second side of the upper attachment frame, wherein the first arm and the second arm include a series of locking pin holes configured to selectively receive a locking pin, wherein the locking pin is selectively movable between a retracted position in which the locking pin is out of the locking pin hole, and a deployed position in which the locking pin extends into the locking pin hole and a stabilizer wheel assembly to secure the stabilizer wheel relative to the upper attachment frame.

18. The method of claim 17 further comprising:

adjusting a stabilizer wheel assembly position along a length of the first arm or the second arm; and deploying the locking pin into the locking pin hole to secure the stabilizer wheel assembly.

19. The method of claim 17, wherein the locking pin holes further enable locking the stabilizer wheel assembly in a lowered position engaging the ground surface and an upright stowed position.

20. A fine grading system for a work machine, the system comprising:

a frame supported by a plurality of ground-engaging units, the ground-engaging units configured to support the frame on a surface;

a boom assembly coupled to the frame, the boom assembly having a pair of boom arms pivotally coupled to the frame and movable relative to the frame by a pair of boom hydraulic actuators;

an attachment coupler coupled to a distal portion of the pair of boom arms, the attachment coupler movable relative to the frame by a pair of pitch hydraulic actuators;

a grading box coupled to the attachment coupler, the grading box extending transversely to the frame;

an upper attachment frame portion having an upper attachment frame length extending forward of the grading box;

a ground-engaging stabilizer wheel coupled to a distal portion of the upper attachment frame portion;

a stabilizer wheel hydraulic actuator is coupling the stabilizer and further coupled to and orthogonally oriented to the upper attachment frame portion, a positioning unit configured to at least raise or lower the grading box relative to the frame via the boom hydraulic actuators and the pitch hydraulic actuators, a hydraulic circuit communicatively coupled to a controller, the hydraulic circuit including a hydraulic pump coupled to the boom hydraulic actuators and the pitch hydraulic actuators, the hydraulic pump delivering fluid through a plurality of flow paths, the plurality of flow paths coupled the boom hydraulic actuators, the pitch hydraulic actuators, and at least one proportional relief valve;

a first hydraulic sensor coupled to the pitch hydraulic actuators and configured to generate a first output signal, the first output signal corresponding to a grading pressure of the pitch hydraulic actuators;

a second hydraulic sensor coupled to the boom hydraulic actuators and configured to generate a second output signal corresponding to a grading pressure of the boom hydraulic actuators;

a third hydraulic sensor coupled to the stabilizer wheel actuator and configured to generate a third output signal corresponding to a grading pressure of the stabilizer wheel actuator; and the controller functionally linked to the first sensor, the second sensor, and the positioning unit, and configured to selectively adjust the at least one proportional relief valve as a function of the first output signal, the second output signal and the third output signal corresponding to the grading pressure to be generated by the pitch hydraulic actuators, the boom hydraulic actuators, and the stabilizer wheel actuator to position the grading box with respect to the ground surface; the controller automatically controlling the at least one proportional relief valve to maintain the target pressure.

* * * * *